United States Patent [19]

Berghahn et al.

[11] 4,021,125

[45] May 3, 1977

[54] BALL ROLL-ON DISPENSER

[75] Inventors: Walter G. Berghahn, Scotch Plains; Jack Weinstein, Old Bridge, both of N.J.

[73] Assignee: Bristol-Myers Company, New York, N.Y.

[22] Filed: Oct. 17, 1975

[21] Appl. No.: 623,890

[52] U.S. Cl. ..... 401/213

[51] Int. Cl.[2] ..... B43K 9/00

[58] Field of Search ..... 401/209, 212, 213, 214, 401/216

[56] References Cited

UNITED STATES PATENTS

| | | | |
|---|---|---|---|
| 2,700,784 | 2/1955 | De Brock | 401/213 |
| 2,749,566 | 6/1956 | Thomas | 401/213 |
| 2,923,957 | 2/1960 | Gentile | 401/213 |

*Primary Examiner*—Lawrence Charles
*Attorney, Agent, or Firm*—Irving Holtzman; George A. Mentis; David J. Mugford

[57] ABSTRACT

A ball type roll-on liquid dispenser provided with a generally spherical ball and relatively small supporting nibs supporting the ball for rotation. A restricted passageway is provided between the ball and neck of the container to meter the liquid contents of the container. A thin retaining ring for retaining the ball is also provided as well as a closure liner adapted to apply variable pressure to the thin retaining ring to control the flow of liquid from the container and to completely seal the container from the atmosphere.

6 Claims, 6 Drawing Figures

BALL ROLL-ON DISPENSER

This invention relates to liquid dispensing devices and more particularly liquid dispensing devices of a so-called roll-on type. Dispensing devices of this general character are well known in the art and have been widely used commercially. A typical device is disclosed in U.S. Pat. No. 2,749,566.

Although dispensers like that shown in U.S. Pat. No. 2,749,566 have had widespread commercial application, there are certain disadvantages that attend their use. One disadvantage is that the relatively small size of the ball makes the application of the contents of the container inconvenient. However, when efforts are made to scale up the size of the ball, several difficulties are encountered both in the operation of the device and in its manufacture. Thus, for example, the flow rate of liquid product coming from a scaled up model of the device shown in U.S. Pat. No. 2,749,566 is fast and difficult to control. Moreover, in molding the retaining rings of the device shown in said patent, in its enlarged version, many faults occur in the casting because of the bulk of the material involved. This makes it difficult to maintain the tolerances that are necessary.

Another disadvantage of prior art ball roll-on devices is the difficulty of cleaning the ball without diluting the contents of the container. In using ball roll-on devices, the surface of the ball exposed to the atmosphere often becomes encrusted with the dried residue of the liquid product contained in the dispenser. Frequently, it is desirable to wash the ball under running tap water. However, with the present roll-on devices, this procedure tends to dilute the contents of the container since the water can run into the container through the space between the ball and the retainer ring. The present invention also seeks to avoid this disadvantage.

It is accordingly an object of the present invention to provide a liquid product roll-on dispenser which avoids the aforesaid disadvantages.

Other and more detailed objects of this invention will be apparent from the following description, claims and drawings wherein.

Figure 1:
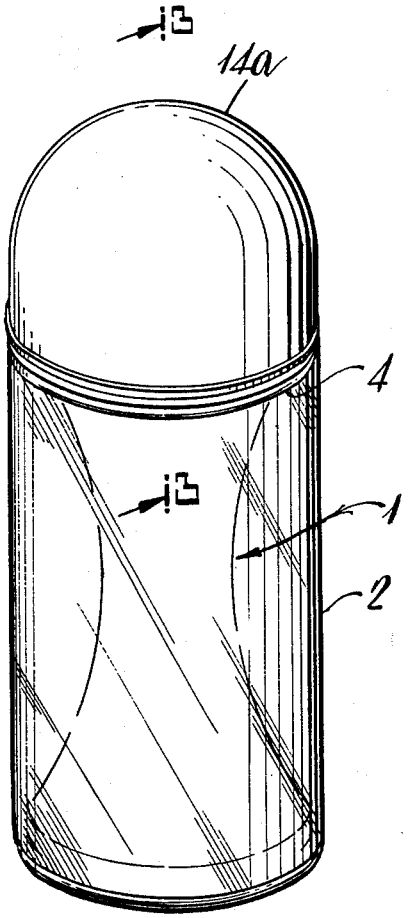
FIG. 1 is a perspective view of a dispenser encompassed in the present invention shown in assembled condition.
Figure 2:
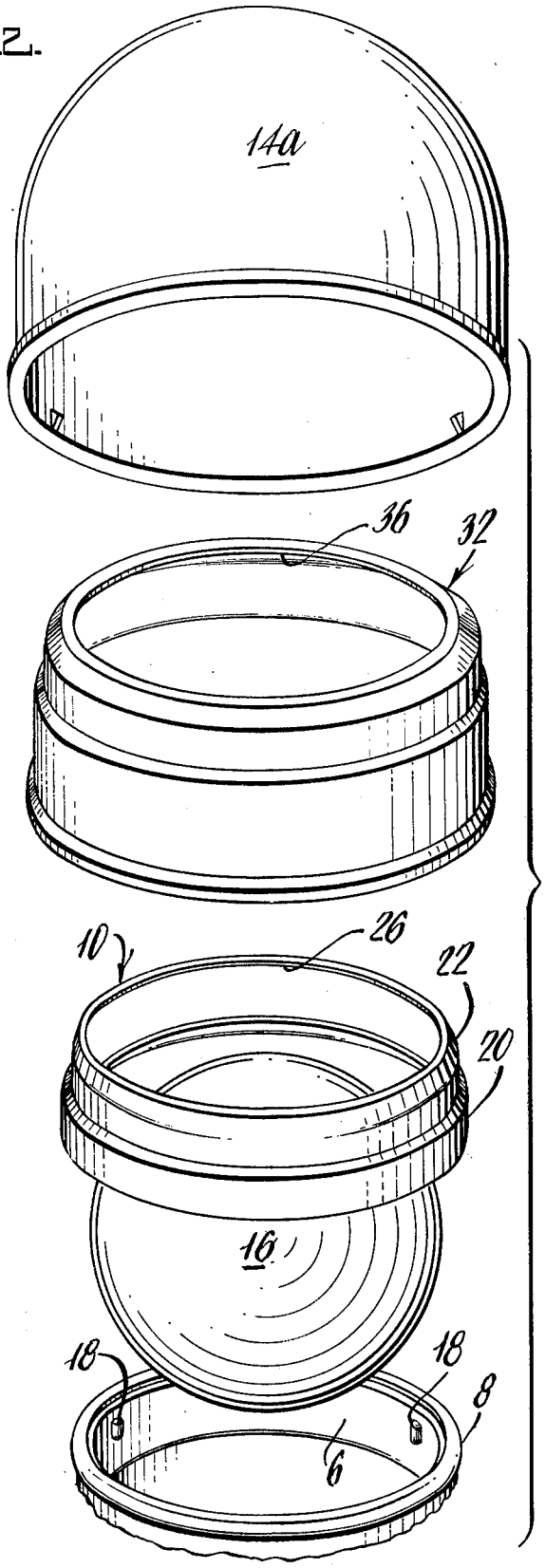
FIG. 2 is an exploded view of the top portion of the dispenser shown in FIG. 1.

Referring to the drawings in which the same number refers to the same structure in the various views, the container is shown generally at 1 which, in this modification of the invention, has an hour glass configuration. In this design, container 1 is also provided with a transparent outer shell 2 through which the hour glass configuration of the container is visible.

The hour glass configuration of container 1 terminates at its upper end in flange 4. Flange 4 serves as the upper stop for outer shell 2 that is slipped over container 1 from below upwardly. Container 1 may be fabricated of any suitable material. However, the materials of choice are synthetic plastics such as polypropylene, polyethylene, polystyrene, polyvinyl chloride. Shell 2 is made of resilient transparent synthetic plastic such as styrene-acrylonitrile copolymer and kept in place on container 1 by means of a friction fit.

Extending upwardly from flange 4 of container 1 and integral therewith is hollow generally cylindrical neck 6. On its outer surface near its upper extremity, neck 6 is provided with a bead 8 which is adapted to engage a cooperating bead on the inner surface of retaining ring 10 in a manner described in more detail below.

Spaced below bead 8 on neck 6 is an external thread 12 that is adapted to mate with an internal thread provided for on closure liner 32. This will also be described in more detail below.

Neck 6, as mentioned, is hollow and communicates from below with the internal cavity of container 1. The internal diameter of neck 6 may be different for different containers. However, it is dimensioned so as to accommodate a relatively large ball 16 in a partially recessed fashion. The internal diameter of neck 6 is accordingly somewhat smaller than the diameter of ball 16. Ordinarily, this diameter will be in the range of from about 0.5 to 2.0 inches and will preferably be about 1.35 to 1.42 inches.

Extending inwardly from the inner surface of neck 6, there is provided a plurality of nibs 18 which serve to rotatably support ball 16 when it is inserted into the opening of neck 6. These are very small relative to the inner diameter of neck 6. The precise vertical dimension and thickness of the nibs may vary somewhat from case to case. However, it will ordinarily have a vertical dimension of about 0.1 inch, a width of about 0.045 inches and a thickness of about 0.015 inches.

Ball 16 is the primary dispensing element in the present device. As mentioned above, it is rotatably mounted in neck 6 and is in a partially recessed relationship therewith. At its upper end, when mounted in neck 6, ball 16 extends above the upper margin of neck 6. Below, ball 16 closes off the open end of container 1 except for the restricted passageway between the surface ball 16 and the internal surface of neck 6. The lower surface of ball 16 is also in contact with the liquid contents of the container when it is inverted for application.

As previously mentioned, ball 16 is relatively large as compared to similar devices now used in the prior art. The larger size of the ball has the advantage that a larger area can be covered by a single stroke of the device than was possible by the prior art ball roll-on devices of this character.

The precise size of ball 16 may vary somewhat. However, it will ordinarily have a diameter in the range of from 0.5 to 2 inches and preferably in the range of from about 1.45 to 1.55 inches. It may be fabricated of any suitable material such as a synthetic plastic. However, the material of choice is polystyrene.

To keep ball 16 in place on the dispenser, there is provided, in accordance with the present invention, a relatively thin retaining ring 10 made of resilient material e.g. low density polyethylene. This will usually have a thickness in the range of from 0.045 to 0.060 inches and a height sufficient to engage the ball above its equator. Retaining ring 10 is divided into a lower container neck engaging portion 20 and an upper ball encompassing portion 22. Portion 20 of ring 10 is provided, on its internal surface, with a bead 24 which snaps over the external bead 8 on neck 6.

Portion 22 of ring 10 on its internal and external surfaces generally follows the curved contour of ball 16 that it surrounds. The internal curvature of portion 22 of ring 10 is such that a small gap is provided between the inner surface of portion 22 and ball 16 so that liquid product may pass therebetween. The inner surface of portion 22 adjacent its upper margin provides a circumferential sealing surface 26 which may be brought into sealing relationship with ball 16 when closure liner 32 is screwed into its down position.

In this modification of the invention, provision is also made for a closure liner 32 adapted to apply variable pressure to retaining ring 10 adjacent to sealing surface 26. Closure liner 32 also has generally a hollow cylindrical shape and is provided on its internal surface near its lower margin with internal threads 34, that mate with the external threads on neck 6.

Closure liner 32, on its inner surface, also has a circumferentially disposed surface 36 that bears against the outer surface of retaining ring 10 near the upper margin thereof. In operation, closure liner 32 is screwed into place after the ball 16 and retaining ring 10 have been put into place. Since surface 36 bears up against the outer surface of retaining ring 10 adjacent circumferentially sealing surface 26, the pressure applied thereto can be regulated by screwing or unscrewing the closure liner 32.

By screwing closure liner 32 well into place, circumferential sealing surface 26 may be completely sealed. In this position, the portion of the ball 16 that is exposed to the atmosphere and extends above the upper margin of closure liner 32 can be washed with running tap water without the danger of any water getting into the container.

Figure 4:
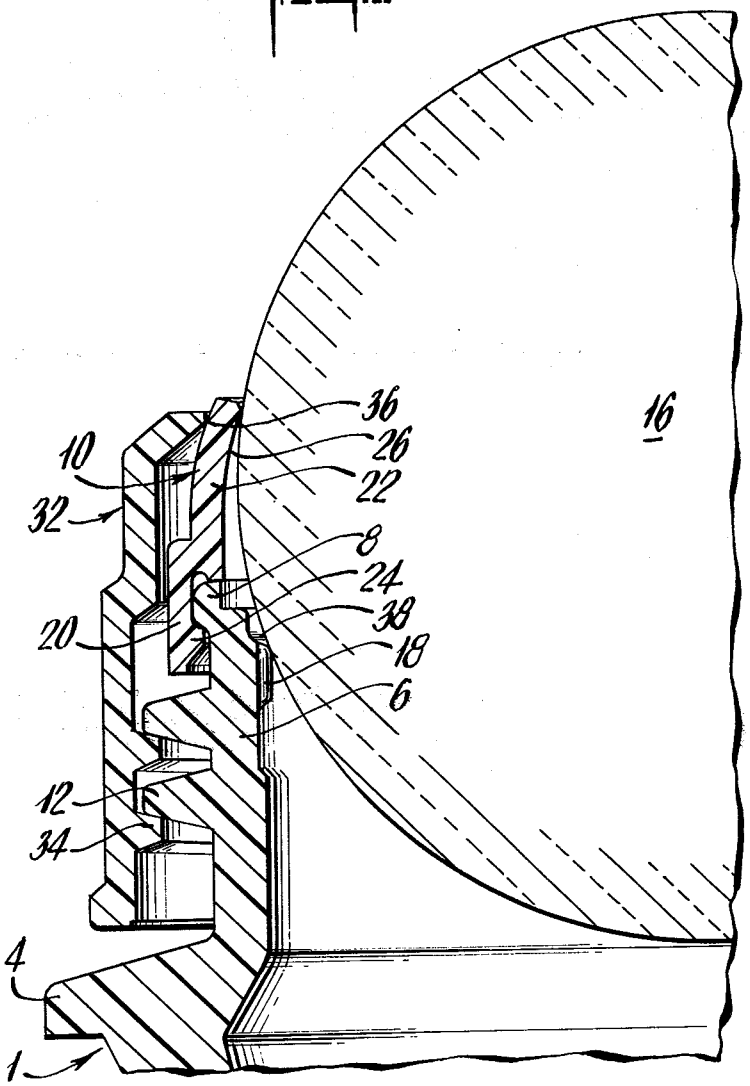
FIG. 4 is a view similar to that shown in FIG. 3 with the overcap removed and with the closure liner screwed down into the sealing position.
Figure 3:
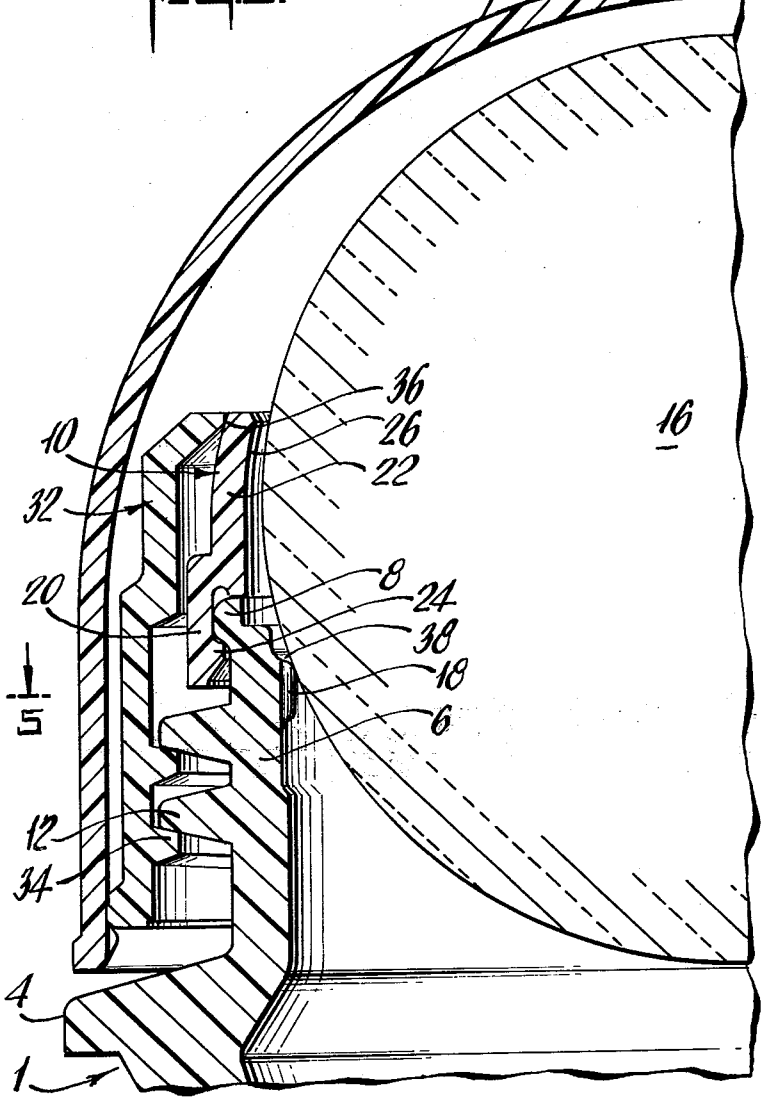
FIG. 3 is an enlarged partial longitudinal sectional view of the dispenser shown in FIG. 1 taken through line 3—3 there showing the closure liner in open position.
Figure 5:
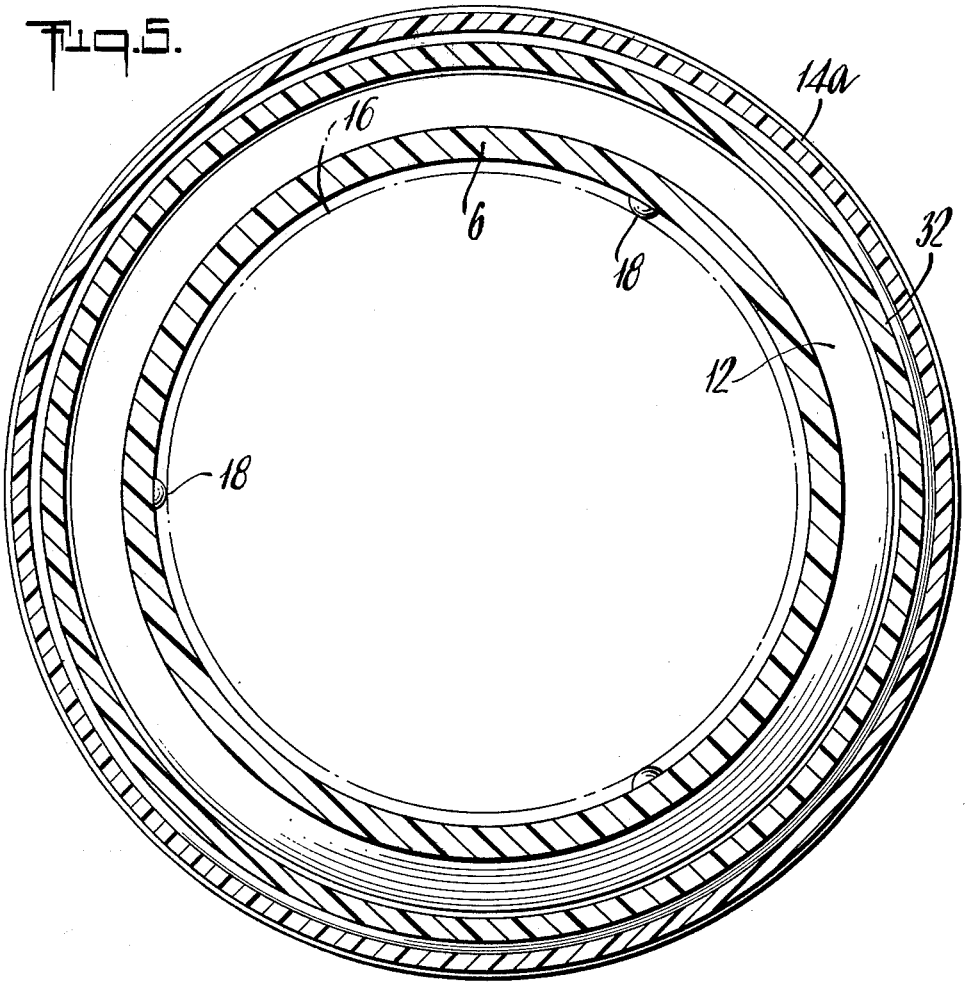
FIG. 5 is a cross-sectional view of the dispenser shown in FIG. 3 taken along line 5—5 of FIG. 3 showing the disposition of the ball supporting nibs.

The relationship between the closure liner 32 and circumferential sealing surface 26 is best seen by comparing FIGS. 3 and 4. In FIG. 3 the closure liner 32 is in the open position and circumferential sealing surface 26 is seen to be spaced from ball 16. In FIG. 4 closure liner 32 is in the closed, screwed down position and sealing surface 26 is shown to be in contact with the surface of ball 16.

The fact that the closure liner 32 is open at the top makes it possible to dispense the contents of the container without removing liner 32. All that is required is that liner 32 be unscrewed sufficiently to release the pressure on the sealing surface 26 to permit the flow of liquid product from the container. Since ball 16 also extends above the upper margin of liner 32, material may be applied without removing liner 32.

In this modification of the invention, the dispenser may also be provided with an overcap 14*a*. Overcap 14*a* will usually be retained on the container by means of a friction fit.

The diameter of ball 16 is somewhat larger than the internal diameter of neck 6. Because of this ball 16 rests in a partially recessed relationship within neck 6. In this relationship, in the absence of nibs 18, the open end of container 1 would be substantially completely sealed off and practically no liquid product could be dispensed from the container.

If, however, on the other hand, relatively large supporting means (i.e. large in a vertical dimension) was provided in neck 6 for supporting ball 16 for rotation, a relatively large gap could be present between the internal surface of neck 6 and the outer surface of ball 16. In this kind of arrangement, since ball 16 is relatively large, the rate of flow of liquid product out of the container would be fast and difficult to control. This is avoided by the present invention by structuring the nibs 18 so that they are very small. This helps to give a gap between the ball 16 and inner surface of neck 6 which is small and which will serve as a metering device for the flow of liquid from the container.

It is a feature of the present invention to provide a restricted passageway 38 between the inner surface of neck 6 and the surface of ball 16 above the upper margin of nibs 18. This will serve as a metering device for controlling the flow of liquid product from the container. The size of this restricted passageway or gap may vary somewhat e.g. less than 0.100 inches. However, the best results are obtained when this gap is in the range of from 0.001 to 0.020 inches. The size of this gap may be established and maintained by fabricating the ball 16 and neck 6 with appropriate diameters for the required rate of flow. In addition, the upper margins of nibs 18 are positioned with respect to the upper margin of neck 6 so that the surfaces of neck 6 and ball 16 are separated to the appropriate extent. This may be accomplished by locating the upper margin of nibs 18 at a distance of from about 0.000 to 0.125 inches below or above the upper margin of neck 6 and preferably 0.075 to 0.125 inches below.

Figure 6:
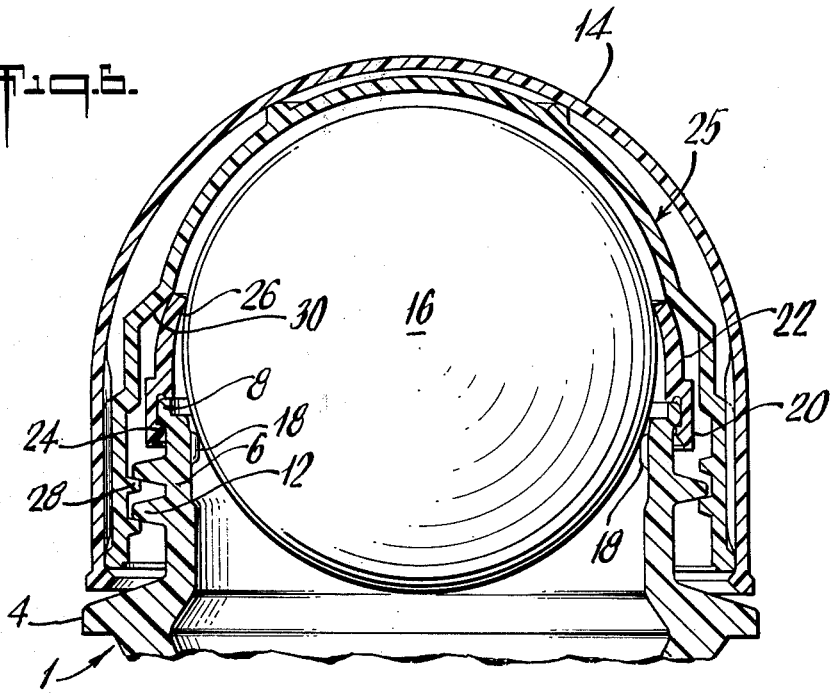
FIG. 6 is a longitudinal sectional view of the top portions of another embodiment of this invention.

The modification of the invention shown in FIG. 6 is similar in most respects as that illustrated in FIGS. 1 to 5. However, the former does not contain the threaded closure liner 32 provided for in the latter. In its place, is a sealing cap 25.

Sealing cap 25 is generally dome-shaped and has near its lower extremity internally disposed threads 28 that are adapted to mate with threads 12 of neck 6 of the container. About midway up the inner surface of sealing cap 25 there is provided a circumferentially extending angularly disposed pressure applying surface 30. Surface 30 is positioned so that when sealing cap 25 is screwed onto neck 6, surface 30 will engage retaining ring 10 adjacent the circumferential sealing surface 26. In this fashion, all communication between the atmosphere and the internal cavity of container 1 can be cut off.

The modification of the invention shown in FIG. 6 may also be provided with an overcap 14. This is maintained in position by a friction fit.

In using the device shown in FIG. 6, overcap 14 is first removed. This is followed by the unscrewing and the complete removal of sealing cap 25. With this removed, the dispenser is ready for use. After use, cap 25 will then be replaced to seal the contents of the container from the atmosphere. The replacement of overcap 14 is optional.

What is claimed is:

1. A dispensing device comprising a container having an open end defined by an annular wall, a generally spherical ball mounted within said open end, a plurality of relatively small nibs extending inwardly from said annular wall and adapted to support said ball for rotation; the relative dimensions of said nibs and the relative diameters of said ball and annular wall being such as to form a first restricted passage of less than 0.1 inches between said ball and annular wall adjacent said nibs for the flow of liquid product from within said container and to serve as a metering device for the flow of said liquid product, a relatively thin resilient retaining ring surrounding said ball adapted to retain said ball inside said open end; said ring being in engagement with the outside of said annular wall, at least a portion of the internal surface of said retaining ring forming a second restricted passage between said ball and said retaining ring for the flow of liquid product contained within said container; a portion of the internal surface of the retaining ring being adapted to serve as a circumferential sealing surface against said ball.

2. A dispensing device according to claim 1 including an overcap having an internal surface and adapted to fit over the end of said dispensing device containing said ball and said retaining ring; said overcap being provided on its internal surface with means for applying pressure to said retaining ring adjacent said circumferential sealing surface.

3. A dispensing device according to claim 1 in which the size of said first restricted passage is in the range of from about 0.001 to 0.020 inches.

4. A dispensing device according to claim 3 in which the upper margin of said nibs is spaced from about 0.075 to 0.125 inches below the upper margin of said annular wall.

5. A dispensing device comprising a container having an open end defined by an annular wall, a generally spherical ball mounted within said open end, a plurality of small nibs extending inwardly from said annular wall and adapted to support said ball for rotation; said ball and annular wall forming a first restricted passage of less than about 0.1 inches for the flow of liquid product from within said container, a relatively thin resilient retaining ring surrounding said ball adapted to retain said ball inside said open end and forming a second restricted passage for the flow of liquid product; said ring being in engagement with the outside of said annular wall, a portion of the internal surface of said retaining ring being adapted to serve as a circumferential sealing surface against said ball, an open ended closure liner encompassing said ring and said ball; said ball partially projecting beyond the upper margin of said open ended closure liner when the latter is in place whereby liquid product may be dispensed from said container when said liner is in place on the container; said liner being provided with means on its internal surface for applying pressure to said retaining ring adjacent to said circumferential sealing surface; said liner being adapted to apply a variable pressure to said retaining ring whereby the rate of flow of liquid product from within said container may be regulated.

6. A device according to claim 5 wherein said open ended liner is provided near its lower end with threads that engage mating threads on said container whereby said open ended liner can apply variable pressure adjacent said circumferential sealing surface by screwing said threaded open ended liner onto the threads on said container.

* * * * *